United States Patent [19]

Addis et al.

[11] 4,202,189

[45] May 13, 1980

[54] APPARATUS FOR THE APPLICATION OF LIQUIDS TO MOVING MATERIALS

[75] Inventors: Kenneth J. Addis, Inman; John K. McCollough, Jr., Spartanburg, both of S.C.

[73] Assignee: Milliken Research Corporation, Spartanburg, S.C.

[21] Appl. No.: 28,715

[22] Filed: Apr. 9, 1979

[51] Int. Cl.[2] ..... D06B 1/02

[52] U.S. Cl. ..... 68/205 R

[58] Field of Search ..... 68/205 R, 183; 239/120, 239/122; 188/314, 315

[56] References Cited

U.S. PATENT DOCUMENTS 3,942,343 3/1976 Klein ..... 68/205 R

*Primary Examiner*—Philip R. Coe

*Attorney, Agent, or Firm*—Earle R. Marden; H. William Petry

[57] ABSTRACT

Apparatus for the application of liquids to moving material, such as patterned application of dyes to moving textile material, including a liquid applicator positioned above the material path of travel for continuously discharging liquid in a row of plural streams downwardly onto the material, means for selectively deflecting selected of the continuously flowing streams in accordance with a pattern control device, and collection means for receiving the deflected liquid to prevent its contact with the moving material, and wherein the collection means includes a collection chamber having an opening for receiving deflected liquid, and three collector plates positioned adjacent the lower portion of the liquid-receiving opening to prevent liquid from falling onto the surface of the moving material from the collection means in an unscheduled manner. The primary collector plate being made of very thin metal and being capable of having tension applied to the extremities.

10 Claims, 7 Drawing Figures

APPARATUS FOR THE APPLICATION OF LIQUIDS TO MOVING MATERIALS

The present invention is directed to apparatus for applying liquids to moving materials and, more particularly, to an improved apparatus for the patterned application of dye or other liquids to moving textile materials such as pile carpets, fabrics and the like.

It is known to apply liquid dyes to moving textile materials from plural streams which are directed onto the materials and selectively controlled to produce a desired pattern thereon. McElveen, U.S. Pat. No. 3,393,411, describes apparatus and process wherein plural streams of dye are selectively controlled in their flow to provide a distinct pattern on a pile carpet.

U.S. Pat. Nos. 3,443,878 and 3,570,275 describe apparatus and process for the patterned dyeing of a moving textile web wherein continuously flowing streams of dye normally directed in paths to impinge upon the web are selectively deflected from contact with the web in accordance with pattern information. The webs are thus dyed in a desired pattern and the deflected dye is collected and recirculated for use.

In such continuous flow, deflection-type dyeing apparatus, it is know to position a plurality of dye applicators, or "dye gun bars", generally above the path of movement of a material to be dyed and wherein each of the gun bars extends across the path of material movement and is provided with a row of dye outlets which project streams of dye downwardly toward the material to be dyed. Each continuously flowing dye stream is selectively deflected by a stream of air which is discharged, in accordance with pattern information from an air outlet located adjacent each dye discharge outlet. The air outlet is positioned to direct the air stream into intersecting relation with the dye stream and to deflect the dye into a collection chamber or trough for recirculation. To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall so that its edge can be accurately positioned relative to the dye discharge axes of the gun bar to insure prompt and precise interception of the streams when deflected. Details of such a dyeing apparatus and collection chamber construction are described and claimed in commonly assigned Klein, U.S. patent application Ser. No. 471,111, filed May 17, 1974, now U.S. Pat. No. 3,942,343.

As described in said application, each dye stream, when deflected, passes across the edge of the collector plate and into the collection chamber. Upon removal of deflection from the stream, the stream moves back across the plate edge and resumes its normal path of travel toward the material to be dyed.

It has been discovered that, during the movement of the stream across the edge of the collector plate, there is a tendency for the portion of the stream moving toward the material to be dyed to attach briefly to the plate, thus forming "trailing portions" of dye from the main body of the stream moving toward the material. These attached trailing portions of dye move downwardly along the under surface of the collector plate for a short distance from the edge before detachment. The distance the trailing edges of the dye streams travel along the under surface of the plate depends upon various factors of the system, e.g. angle and curvature of the collector plate, dye viscosity, surface tension, dye stream pressure, etc. When the trailing edges of the dye streams separate from the lower surface of the collector plate, it has been found that a very fine mist of dye is produced in the area beneath the collector plate and above the surface of the material to be dyed. It has been observed that a collection of dye forms on the under surface of the lower wall of the collection chamber which produces occasional drops which fall from the collection chamber onto the materials being dyed. These droplets can, of course, adversely effect the pattern formed on the material.

The present invention is directed to an improvement in dyeing apparatus of the type described which minimizes and/or eliminates the adverse effects of the dye mist and droplets formed during the pattern dyeing operation and employs a primary deflection which can be aligned and adjusted without adverse stress on the deflector blade.

The invention will be better understood and further explained by reference to the accompanying drawings, in which.

Figure 1:
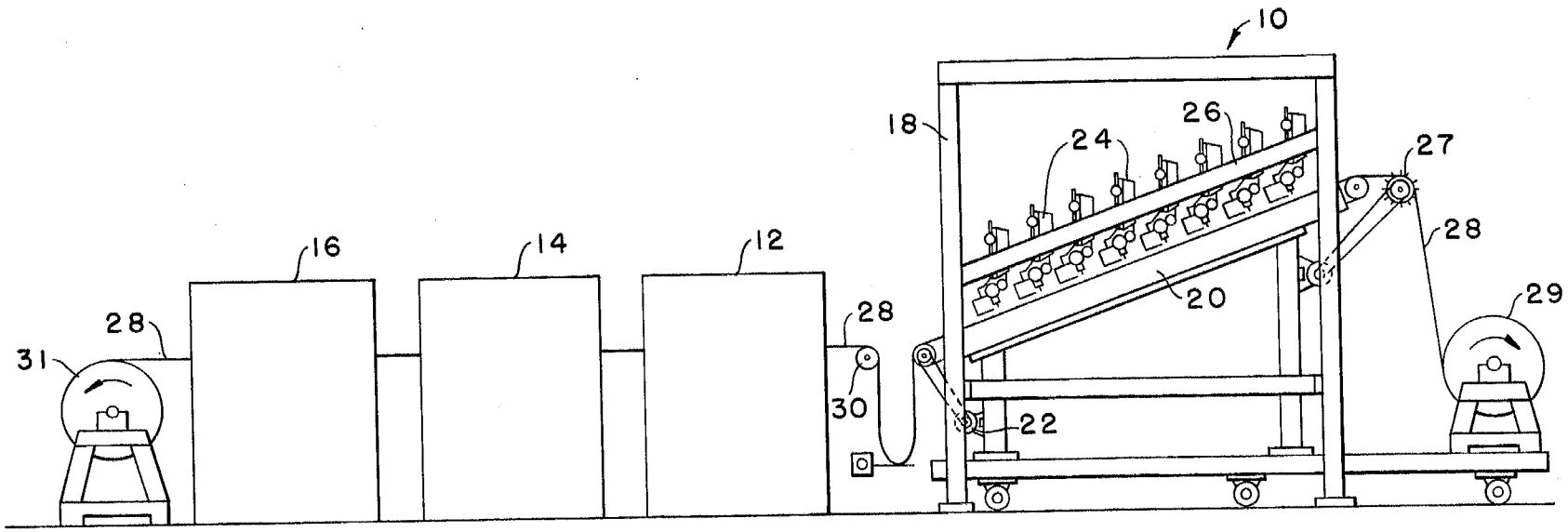
FIG. 1 is a schematic side elevation of apparatus for dyeing a moving material.

Referring more specifically to the drawings, FIG. 1 shows, in schematic side elevation, apparatus for applying liquids to a moving material to which the present invention pertains. As shown and as will be described, the apparatus is particularly adapted for the patterned application of dyes to a moving length of pile carpet material; however, it is to be understood that the liquid applicator of the apparatus could be employed to apply various types of liquids to various moving materials in a programmed manner.

The dyeing apparatus shown generally comprises a dye applicator section 10, a steam chamber 12, a washer 14, and a dryer 16. The dye applicator section 10 is composed of a main frame 18 supporting an inclined conveyor 20 which is driven by motor means 22. Positioned above and spaced along the length of the conveyor are plurality of dye applicator members, or gun bars 24, (8 being shown), which extend in parallel, spaced relation across the width of the conveyor and are suitably supported at their ends by attachment to diagonal frame members (one of which, 26, is shown) on either side of the conveyor. For pattern dyeing broadloom carpets, the conveyor conveniently may be 12 to 15 feet in width and the gun bars 24 each are provided with a different color dye to apply a colored pattern to the carpet.

In operation, a length of carpet 28 is continuously withdrawn from a supply roll 29 by a driven pinroller 27 and delivered to the inclined conveyor 20 which transports the carpet beneath the gun bars 24. Each gun bar is provided with a different colored liquid dye which is dispensed in streams from orifices or outlets spaced along the gun bar onto the carpet as it passes through the applicator section 10. Details of the construction and control of gun bars will be explained hereinafter. Dyed carpet leaving conveyor 20 is directed by suitable support means, such as guide rollers, one of which 30 is shown, through the steam chamber 12, the washer 14, and the dryer 16 where the dyed carpet is treated in conventional manner to fix the dye, remove excess dye, and dry the dyed carpet, respectively. Details of the dye-fixing steam chamber 12, washer 14, and dryer 16 do not form part of the present invention and apparatus for performing such conventional practices are well known in the art. The dyed carpet is collected on a collection roll 31.

Figure 2:
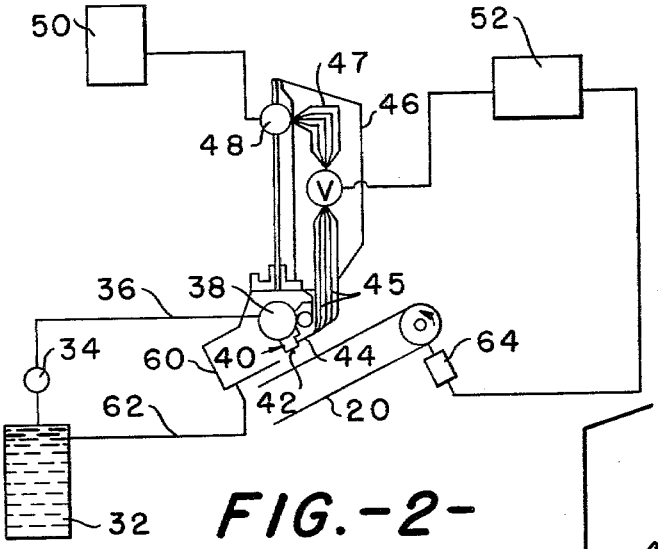
FIG. 2 is a schematic drawing of a single dye applicator, or gun bar, of the apparatus of FIG. 1 and shows a basic arrangement for supplying dye to and from, and air under pressure to, each of the gun bars, together with control means for programming the same.

The gun bars 24 are of substantially identical construction and the details of their construction and operation can better be described by reference to FIGS. 2 and 3. As seen in FIG. 2, which is a schematic side elevation of a gun bar 24, each gun bar is provided with a separate dye reservoir tank 32 which supplies liquid dye, by means of pump 34 and conduit means 36, under pressure to a dye manifold pipe 38 of the gun bar. Pipe 38 communicates at suitable locations along its length with a sub-manifold section 40 attached to the pipe. The manifold pipe 38 and sub-manifold section 40 extend across the width of the conveyor 20 and sub-manifold section 40 is provided with a plurality of dye outlets 42 spaced along its length to continuously discharge a row of parallel dye streams downwardly toward the material to be dyed.

Positioned adjacent and at about a right angle to each dye outlet 42 of sub-manifold section 40 is an outlet of an air supply tube 44. Each air tube communicates by way of a conduit or tube 45 with a separate valve, illustrated collectively by the symbol V, located in a valve support box 46 of the gun bar. Each valve is, in turn, connected by a conduit or tube 47 to an air supply manifold 48 which is provided with pressurized air by a compressor 50. Each of the valves V, which may be of the electromagnetic solenoid type, are individually controlled by electrical signals from a pattern control device 52. The air outlets of tubes 44 provide streams of air to impinge at approximately right angles against the continuously flowing dye streams from the dye outlets 42 and deflect the same into a collection chamber or trough 60 from which liquid dye is removed, by way of suitable conduit means 62, to dye reservoir tank 32 for recirculation.

The pattern control device 52 for operating the solenoid valves may be composed of various type pattern control means, such as a computer with magnetic tape transport for pattern information storage. Desired pattern information from control device 52 is transmitted to the solenoid valves of each gun bar at appropriate times in response to conveyor movement which is transmitted by suitable transducer means 64 operatively connecting the conveyor 20 and pattern control device 52.

In a typical dyeing operation utilizing the presently disclosed apparatus, when no pattern dyeing information is supplied to the air valves of the gun bars from the control device 52, the valves remain "open" to permit passage of pressurized air through supply tubes 44 to continuously deflect all of the continuously flowing dye streams from the gun bar outlets 42 into the collection trough 60 for recirculation. When carpet to be dyed passes beneath the first gun bar of the dye applicator section 10, pattern control device 52 is actuated in suitable manner, such as manually by an operator. Thereafter, signals from transducer 64 release pattern information from device 52 to selectively "close" the air valves so that the corresponding dye streams are not deflected, but pass in their normal discharge paths to strike the carpet. Thus, by operating the solenoid air valves of each gun bar in the desired pattern sequence, a colored pattern of dye is placed on the carpet during its passage through the dye applicator section 10.

Figure 3:
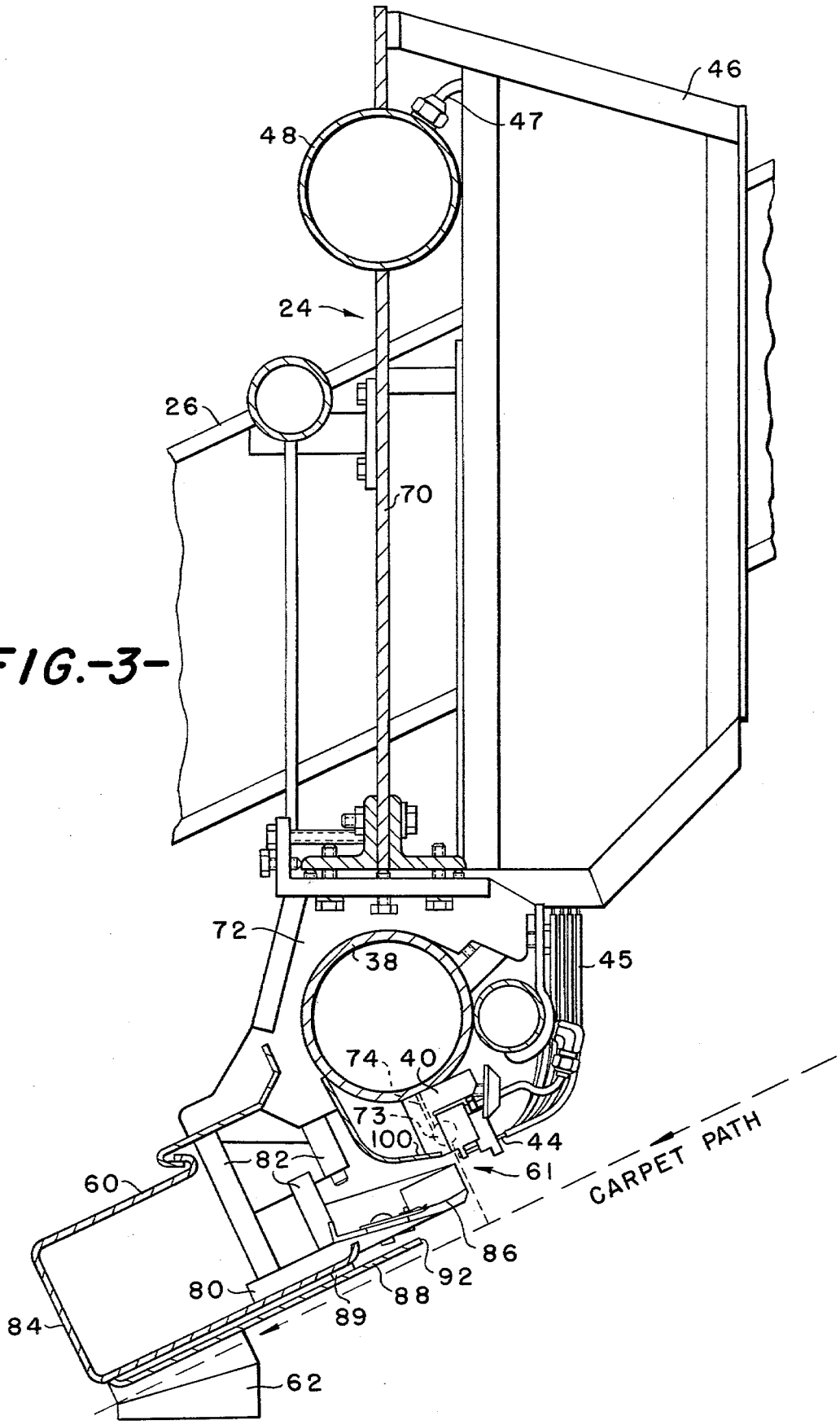
FIG. 3 is an enlarged side view, partially in section, of a gun bar of the apparatus of the present invention, and showing in more detail the positional arrangement of the dye applicator section and dye collection chamber of the gun bar.

Details of the construction of each gun bar are best shown in FIG. 3 which is an end elevation view, partially in section, of one of the gun bars 24. As seen, each gun bar includes a main structural support plate 70 which extends across the full width of the conveyor and is supportably attached to the diagonal members of the support frame 18. Attached to the upper portion of plate 70 is the air supply manifold 48 and adjustably attached to the lower flanged edge of the plate, by suitable bracket and clamp means 72, which are spaced along the length of plate 70, is the dye manifold pipe 38. Sub-manifold section 40 is suitably attached, as by bolts (not shown), to dye manifold pipe 38 and has a sub-manifold chamber 73 which communicates by way of a plurality of passageways 74 spaced along pipe 38 with an interior chamber of manifold pipe 38 which receive dye therefrom. The dye-receiving chamber 73 of sub-manifold section 40 is provided with the plurality of dye discharge outlets 42 which are spaced along the length of sub-manifold section 40 and across the width of the conveyor to discharge dye in a row of parallel streams onto the moving carpet. Details of the dye manifold and sub-manifold construction form the subject of, commonly assigned U.S. patent application Ser. No. 471,110, filed may 17, 1974, now U.S. Pat. No. 3,942,342.

Figure 4:
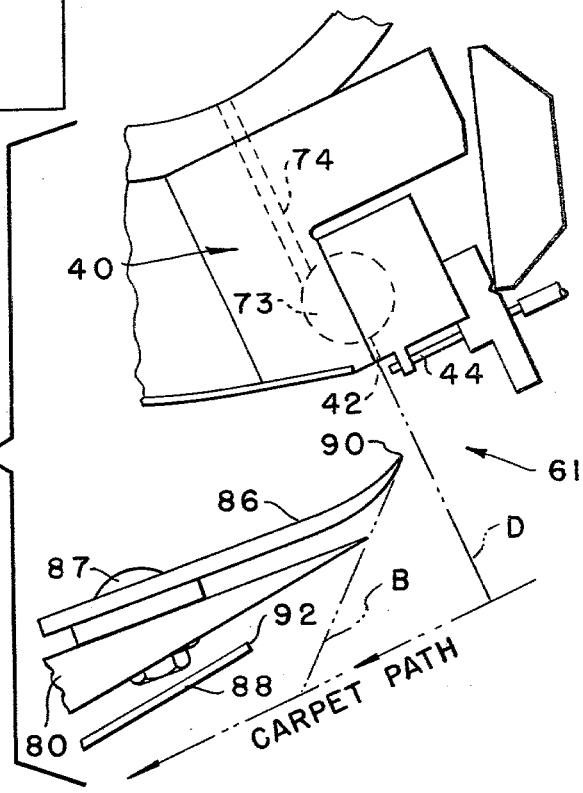
FIG. 4 is an enlarged, broken away, schematic side view of the lower portion of the dye applicator and entrance opening of the collection chamber of the gun bar of FIG. 3.

Details of the construction and arrangement of the dye collection trough or chamber of the present invention may be best described by reference to FIGS. 3–5. The collection chamber 60 includes a relatively thick, rigid main support plate, or bar 80 which extends the entire length of the gun bar and is attached thereto at spaced locations along the length of the gun bar by rod members 82 connecting plate 80 to the clamping means 72. To provide positional stability for the collection chamber, the support plate 80 is formed of a high strength material, such as a relatively thick stainless steel plate.

The outer walls 84 of the collection chamber are conveniently formed of a thin, lightweight material, such as stainless steel sheet metal, attached in suitable manner to support plate 80 and clamping means 72 of the gun bar (FIG. 3). The outer edge portion of plate 80 is suitably tapered, as shown, to form a sharp edge which extends generally parallel to the row of dye outlets 42 of the gun bar. The support plate 80 also serves as a secondary dye collector, as will be explained.

Supportably positioned in spaced relation above the upper surface of the tapered portion of support plate 80 is a first, or primary dye collector plate 86 which extends the length of the gun bar and has a sharp outer edge positioned closely adjacent and parallel to the row of discharge outlets of the gun bar. The primary collector plate 86 is adjustably attached, as by bolt and spacer means 87, at spaced locations along its length to the upper surface of support plate 80 so that the plate 86 may be moved to position its outer edge relative to the dye discharge axes of the dye outlets. Various fastening means may be employed for adjustably mounting the primary collector plate and one such means is disclosed in previously referred to Klein, U.S. patent application Ser. No. 471,111.

Supportably attached, as by screw and spacer means 89, in a spaced relation below the support plate 80 is a third dye collector plate 88, the outer edge of which extends generally parallel to the outer edges of plates 80 and 86 and is located at a further distance from the discharge axes of the dye outlets of the gun bar than these two edges. In the embodiment shown in FIG. 3, the third collector plate 88 does not communicate directly with the interior of the dye collection chamber, but extends in spaced relation below the collection chamber throughout its length to points beyond both sides of the conveyor so that dye collected by the third collector plate may drain from the open sides of the collector plate without striking the moving carpet being dyed.

As seen, the collection chamber 60 has an elongate opening or entrance 61 for the reception of deflected dye. The opening extends the length of the gun bar and is located on the opposite side of the discharge axes D (FIG. 4) of the dye outlets 42 from the air supply tubes 44. The dye deflected by streams of air from the air supply tubes passes into the opening of the dye collection chamber and flows by gravity into the lower interior portion of the chamber. The collected dye is removed, as by gravity, from the collection chamber through one or more drain lines 62 which direct the dye back to the dye reservoir 32 for recirculation.

The manner in which the dye collection chamber functions during operation of the dyeing apparatus of the present invention is best described by reference to FIG. 4, which shows, on an enlarged schematic scale, the sub-manifold section 40 of the gun bar and the outer edge portions of the dye collector plates 80, 86, 88 of the collection chamber. The outer edge 90 of the first or primary collector plate is positioned closely adjacent the discharge axes D of the dye outlets to facilitate precise interception of the streams during deflection. The outer edge portion of the first collector plate is curved upwardly, as seen in side elevation, to facilitate gravitational flow of the intercepted dye downwardly into the interior portion of the collection chamber. As has been previously described, when a selected dye stream is deflected from its normal path of travel D onto the surface of the moving carpet, the pressurized air stream from its respective air tube deflects or displaces the stream across the edge 90 of the primary deflector plate 86 and onto its upper surface. As the stream is deflected, it has been found that the last portion of the dye stream which is continuing in its path D to strike the carpet tends to attach momentarily to the under surface of plate 86. When deflection is removed from the stream and the stream moves back across the edge of the collector plate to resume its normal path of discharge D, this same attachment effect has been observed. These attached portions of the dye stream move downwardly along the under surface of the first collector plate and separate from the surface a short distance from the edge 90.

Upon separation, it has been observed that a portion of dye remains on the under surface of the first collector plate to form droplets which will pass along the lower surface of the first plate into the collection chamber or fall from the under surface onto the upper surface of support plate 80. Thus, support plate 80 serves as a secondary collector for dye to receive drops of dye falling from the primary collector plate 86 and pass these drops into the collection chamber.

It has also been observed that separation of the dye streams from the first collector plate creates a fine mist of dye in an area, or zone, between the first collector plate and the upper surface of the carpet being dyed. This dye mist is of sufficient fineness that, in dispersed state, it does not adversely effect the pattern of dye applied to the carpet; however, portions of the mist coalesce and attach to the secondary collector plate and at times form a sufficient amount of dye on the under surface of the plate to cause drops of dye which fall by gravity from the surface of the plate. To intercept these drops and prevent their falling on the carpet, third collector plate 88 is positioned in spaced relation below the support plate 80. To prevent a similar collection of dye mist on the third collector plate, the edge 92 of plate 88 is positioned at a greater distance from the discharge axes of the dye streams than the edge of the second collector plate. The second collector plate thereby acts as a shield for the third collector plate by defining a boundary for the zone of mist created to prevent the mist from passing into the area of the third collector plate and attaching to its surface to form drops of dye. It has been found that this boundary may be approximated by a plane B tangent to the edge surfaces of plates 80 and 86, as illustrated in FIG. 4. Thus the edge of third collector plate 88 may advantageously be located at a distance slightly further from the discharge axes of the dye outlets than the plane B.

Thus, by providing a collection chamber having a series of three collector plates having their outer edges spaced at progressively grater distances from the discharge axes of the gun bar outlets, the plates effectively eliminate the problem of dye mist and dye drop disruption of the pattern being applied to the carpet.

Figure 6:
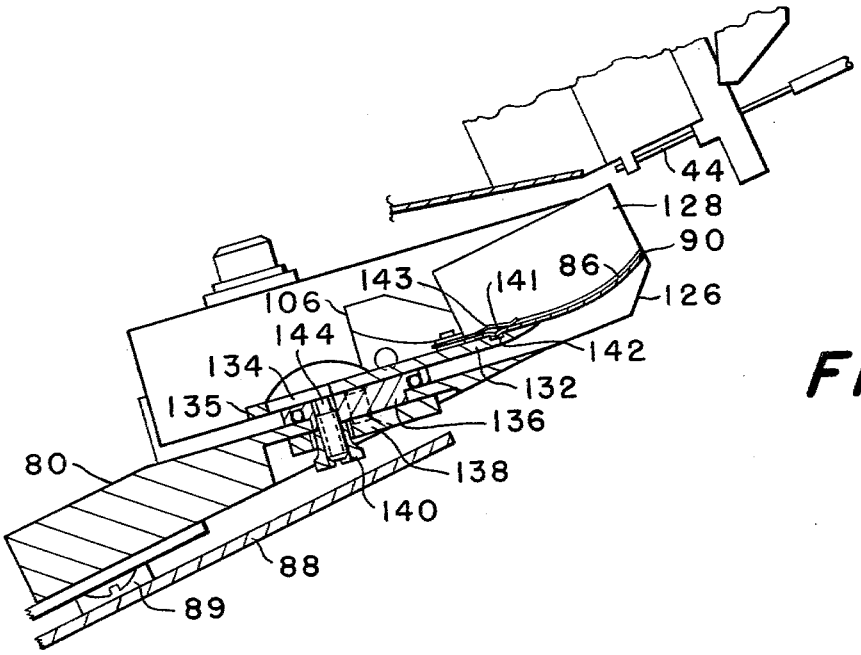
FIG. 6 is a view taken on line 6—6 of FIG. 5.
Figure 5:
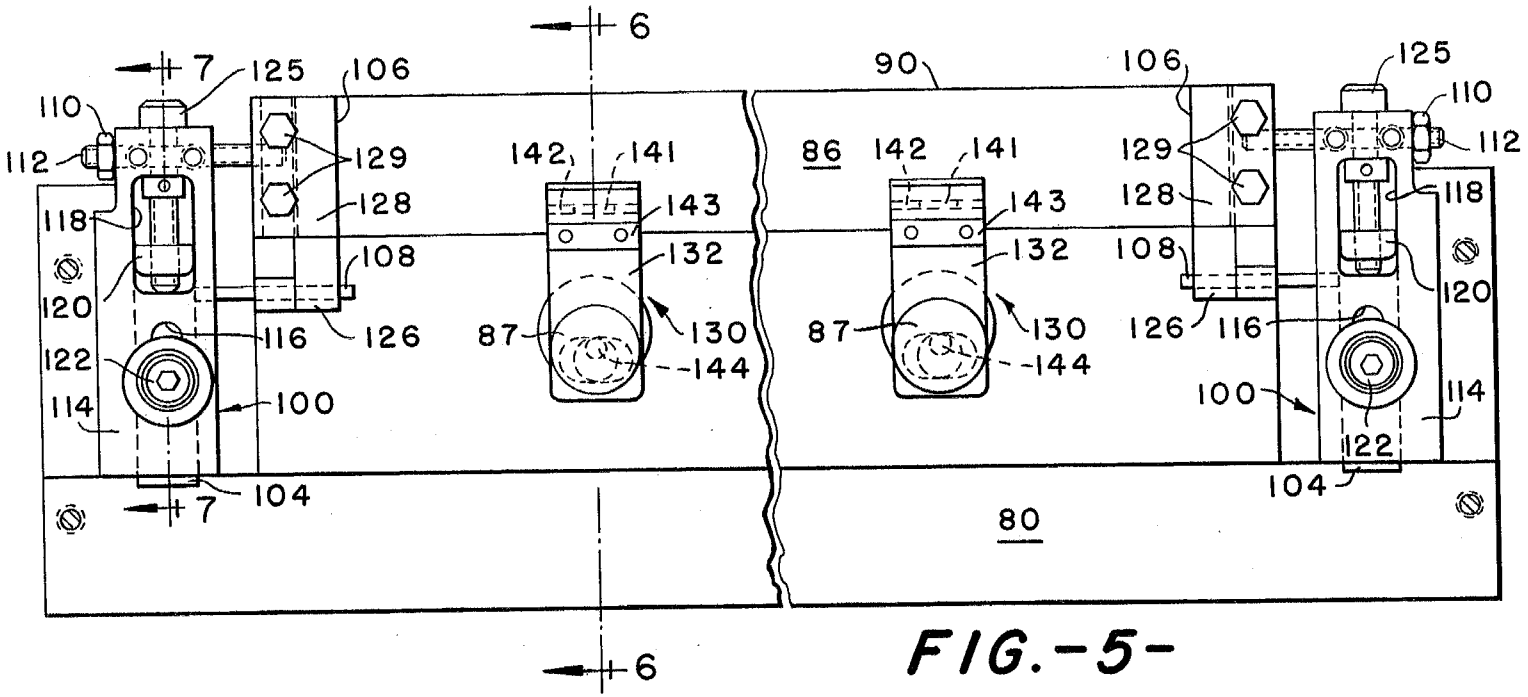
FIG. 5 is a top view of the new and improved air deflector means and its adjustable mounting.
Figure 7:
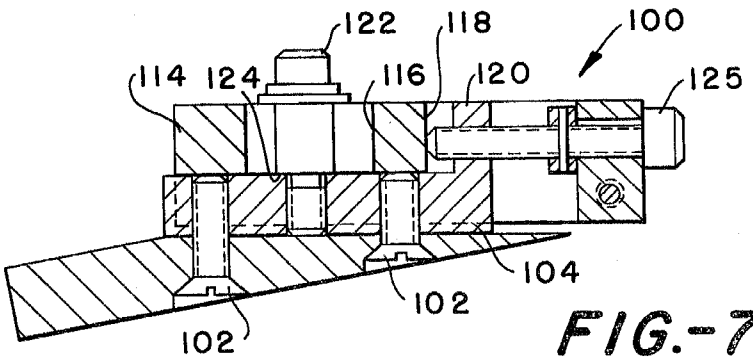
FIG. 7 is a view taken on line 7—7 of FIG. 5.

FIGS. 5–6 illustrate the specific mounting and adjustment apparatus for the primary dye deflector blade 86. The dye deflector blade 86 is made from a very thin stainless steel of a thickness of approximately ten thousandths of an inch. The improved mounting and adjustment apparatus for the primary dye deflector blade 86 is secured in position by the end supports 100 secured to the support plate 80 by suitable screws 102, screwed into the block 104 of the end supports 100. The blade 86, at its extremities, is secured in a manner hereinafter explained to the blade support member 106. Blade support 106 is slidable relative to end support 100 on short shaft 108 fixed to the end support 100 by adjustment of the nut 110 on both of the end supports 100. The adjustments of the nut 110 on the screw shaft 112 tends to slide the blade support member 106 on the shaft 108 to adjust the tension on the blade 86.

Each of the end supports consist of the housing 114 and the block 104 which is secured to the support plate 80. The housing 114 has an elliptical slot 116 therein and an opening 118 through which projects the flange 120 on the block 104. The housing 114 is secured in a position by a shoulder bolt 122 which has a shoulder 124 which abuts the surface of the block 104 to prevent the bolt 122 from restraining sliding movement of the housing 114 relative thereto. When the bolt 125 is adjusted by screws at inward or outward, the housing 114 is slid inward or outward to position the front edge 90 of the blade 86.

As briefly mentioned before the blade 86 is secured at its ends in the blade support member 106. The blade support member 106 basically consists of the bottom portion 126 which is connected to the shaft 108 and the screw shaft 112 and the top portion 128 which is screwed to the bottom portion 126 by suitable screws 129 to clamp the blade 86 therebetween.

Spaced along the blade 86 are blade support members 130 which can be individually adjusted to correct the alignment of the front edge 90 of the blade 86 at spaced points. The blade support member consists of the blade adjustment arm 132, cam 134, a follower 135, sealing disc 136, lock washer 138 and lock nut 140. The blade support member 130 is secured in an opening in the support plate 80 between the sealing disc 136 and the lock washer 138 so that the long end of adjustment arm 132 projects toward the air jet 44 and supports the blade 86. The blade 86 has a plurality of indentations 141 therein which lock into the groove 142 of the adjustment arm 132 to properly locate the blade and held therein by spring retaining clip 131 riveted or otherwise secured to the adjustment arm. The locknut 140 presses the sealing disc 136 against the bottom portion of the adjustment arm to prevent displacement of adjustment arm.

When it is desired to change the forward position of any front portion 90 of the blade 86, the closest support member or members 130 are adjusted by unscrewing the lock nut 140 and with an Allen wrench inserted in the bottom of the cam shaft 144, rotating the eccentrically mounted cam 134 to slide the adjustment arm 132 to the desired position. The lock nut 140 is then screwed back into a tightened position.

It is obvious that the above described primary dye deflector blade 86 is securely held in operative position and is capable of exact positioning since the new mounting structure allows proper positioning of the overall blade, tensioning of the ends of the thin dye deflector blade to align the point of the blade and to maintain the blade taunt and individual adjustment along the length of the blade to exactly align the blade in the desired position to do the desired job.

Although the preferred embodiment of the invention has been described, it is contemplated that changes may be made without departing from the scope or spirit of the invention and we desire to be limited only by the claims.

We claim:

1. In an apparatus for applying liquids to moving material having means for conveying the material in a pre-determined path of travel, liquid applicator means having a row of outlets positioned above the path of travel of the material for continuously discharging a row of generally parallel streams of liquid downwardly toward the path of travel of the material, fluid discharge means positioned on one side of said row of outlets so that the discharge axes of said fluid discharge means intersect the discharge axes of said outlets, a liquid collection chamber mounted on the other side of said row of outlets, means supplying fluid to said fluid discharge means to direct liquid from said liquid application means into said liquid collection chamber and means mounting a long, thin liquid deflector blade in the path of travel of the liquid deflected by said fluid discharge means to said liquid collection chamber, said means mounting said deflector blade including a means to adjustably position said deflector blade relative to said row of outlets, a second means to apply tension to the end of said deflector blade and a third means to adjust selected portions of the outer edge of said deflector blade relative to other outer portions of said deflector blade.

2. The apparatus of claim 1 wherein said means mounting said deflector blade includes a first elongated support member extending across said apparatus substantially perpendicular to said row of outlets, said first means including a first support member mounted on each end of said elongated support member, said second means including a blade support member connected to each end of said deflector blade and slidably mounted to first support means, said means mounting said deflector blade including a means operably associated with said first means and said second means to allow said blade support member to be slid to control the tension on said deflector blade.

3. The apparatus of claim 2 wherein said third means includes a plurality of elongated blade support members mounted to said first elongated support member and having the back edge of said blade member slidably supported therein.

4. In an apparatus for applying liquids to moving material having means for conveying the material in a pre-determined path of travel, liquid applicator means having a row of outlets positioned above the path of travel of the material for continuously discharging a row of generally parallel streams of liquid downwardly toward the path of travel of the material, fluid discharge means positioned on one side of said row of outlets so that the discharge axes of said fluid discharge means intersect the discharge axes of said outlets, a liquid collection chamber mounted on the other side of said row of outlets, means supplying fluid to said fluid discharge means to direct liquid from said liquid application means into said liquid collection chamber and means mounting a long, thin liquid deflector blade in the path of travel of the liquid deflected by said fluid discharge means to said liquid collection chamber, said means mounting said deflector blade including a means to adjustably position said deflector blade relative to said row of outlets and a second means to apply an outward tension to the ends of said thin, elongated deflector blade.

5. The apparatus of claim 4 wherein said means mounting said deflector blade includes a first elongated support member extending across said apparatus substantially perpendicular to said row of outlets, said first means including a first support member mounted on each end of said elongated support member, said second means including a blade support member connected to each end of said deflector blade and slidably mounted to first support means, said means mounting said deflector blade including a means operably associated with said first means and said second means to allow said blade support member to be slid to control the tension on said deflector blade.

6. In an apparatus for applying liquids to moving material having means for conveying the material in a pre-determined path of travel, liquid applicator means having a row of outlets positioned above the path of travel of the material for continuously discharging a row of generally parallel streams of liquid downwardly toward the path of travel of the material, fluid discharge means positioned on one side of said row of outlets so that the discharge axes of said fluid discharge means intersect the discharge axes of said outlets, a liquid collection chamber mounted on the other side of said row of outlets, means supplying fluid to said fluid discharge means to direct liquid from said liquid application means into said liquid collection chamber and means mounting a long, thin liquid deflector blade in the path of travel of the liquid deflected by said fluid discharge means to said liquid collection chamber, said means mounting said deflector blade including a means to apply an outward tension to the ends of said thin, elongated deflector blade.

7. The apparatus of claim 6 wherein said means mounting said deflector blade includes a second means to adjust selected portions of the outer edge of said deflector blade relative to other outer portions of said deflector blade.

8. The apparatus of claim 7 wherein said means mounting said deflector blade includes a first elongated support member extending across said apparatus substantially perpendicular to said row of outlets, said first means including a first support member mounted on each end of said elongated support member, said second means including a blade support member connected to each end of said deflector blade and slidably mounted to first support means, said means mounting said deflector blade including a means operably associated with said first means and said second means to allow said blade support member to be slid to control the tension on said deflector blade.

9. The apparatus of claim 8 wherein said third means includes a plurality of elongated blade support members mounted to said first elongated support member and having the back edge of said blade member slidably supported therein.

10. The apparatus of claim 6 wherein said means mounting said deflector blade includes a first elongated support member extending across said apparatus substantially perpendicular to said row of outlets, said means to adjust selected portions of the outer edge of the deflector blade including a plurality of elongated blade support members mounted to said first elongated support member and having the back edge of said blade member slidably supported therein.

* * * * *